United States Patent [19]

Post

[11] Patent Number: 4,534,473

[45] Date of Patent: Aug. 13, 1985

[54] DISPLAY STAND

[75] Inventor: William L. Post, Chatsworth, Calif.

[73] Assignee: Pacific Display Corporation, Chatsworth, Calif.

[21] Appl. No.: 566,318

[22] Filed: Dec. 28, 1983

[51] Int. Cl.[3] ..... A47F 5/02

[52] U.S. Cl. ..... 211/58; 108/106; 108/111; 211/131; 211/186; 211/166; 211/207

[58] Field of Search ..... 211/58, 163, 128, 131, 211/153, 144, 186, 187, 70, 77, 78, 129, 166, 133, 107; 108/94, 95, 101, 111, 106

[56] References Cited

U.S. PATENT DOCUMENTS

| | | | |
|---|---|---|---|
| 3,685,664 | 8/1972 | Kramer | 108/111 X |
| 3,777,895 | 12/1973 | Weinstein et al. | 211/163 X |
| 3,785,499 | 1/1974 | Gedye | 211/163 X |
| 3,844,230 | 10/1974 | Hudson et al. | 211/163 X |
| 4,014,437 | 3/1977 | Rumble et al. | 211/4 |
| 4,262,439 | 4/1981 | Dinan et al. | 211/187 X |

*Primary Examiner*—Robert W. Gibson, Jr.
*Attorney, Agent, or Firm*—Christie, Parker & Hale

[57] ABSTRACT

A rotating stand or rack is provided for displaying various items of merchandise, such as greeting cards, paperback books, cassettes, cartridges, floppy disks, folders, and the like. The stand includes an elongated shaft mounted on the base for rotation around its longitudinal axis. The shaft extends away from the base and has a plurality of grooves in its outer surface extending along its length. One or more shelves are mounted on the shaft. Each shelf has an opening through its center and a plurality of guides around the shelf which extend into the shelf opening along its height. The number and positioning of the guides corresponds to the number and positioning of the shaft grooves so that when the shelf is on the shaft, the shelf guides are in the shaft grooves. The size of the grooves and guides are such that they provide a press or friction fit with each other to thereby hold the shelf firmly in position on the shaft.

8 Claims, 7 Drawing Figures

DISPLAY STAND

FIELD OF THE INVENTION

This invention relates to an attractive rotating stand or rack useful for displaying items, such as greeting cards, paperback books, cassettes, cartridges, floppy disks, folders, brochures, and the like.

BACKGROUND OF THE INVENTION

One type of rack that is presently used to display items of merchandise, such as greeting cards, paperback books, and the like, is a standing wire rack that can be turned or rotated. Such a rotatable wire rack is able to carry a fairly large number of such items, while taking up only a relatively small amount of floor space.

Wire racks, however, present a fairly unattractive display. This is because the wire rack itself is relatively unattractive and, additionally, since one or more of the wires generally extends in front of the item being viewed, the attractiveness of the item is diminished.

Wire display racks are commonly provided in standard sizes. For example, standard wire racks for displaying paperback books are provided with shelf spacings that accommodate the normal 4-inch by 6½-inch size paperback. If the items to be displayed are of non-standard size, wire racks for use in displaying such items must be specially ordered. This increases the expense of the rack.

There is, therefore, a need in the art for a rotatable rack that provides a relatively more attractive display than is provided by a wire rack and which can be manufactured economically with any desired shelf spacing.

SUMMARY OF THE INVENTION

This invention relates to an attractive economical display rack that comprises an elongated shaft that is rotatably mounted on a base. The shaft extends away from the base and has at least one groove in its outer surface that extends along the length of the shaft. At least one shelf is mounted on the shaft. Such a shelf has an opening though its center and at least one elongated guide is on the shelf extending into the opening. Such an elongated guide is along the height of the opening and is aligned for sliding engagement in the shaft groove when the shelf is being mounted on the shaft. When the shelf is positioned on the shaft, the shaft is through the shelf opening and the shelf guide is frictionally engaged in the shaft groove.

The display rack of this invention can be economically provided with any desired shelf spacing and can be of any desired height.

BRIEF DESCRIPTION OF THE DRAWINGS

These and other features, aspects, and advantages of the present invention will be more fully understood when considered with respect to the following detailed description, appended claims, and accompanying drawings, wherein:

DETAILED DESCRIPTION

Figure 1:
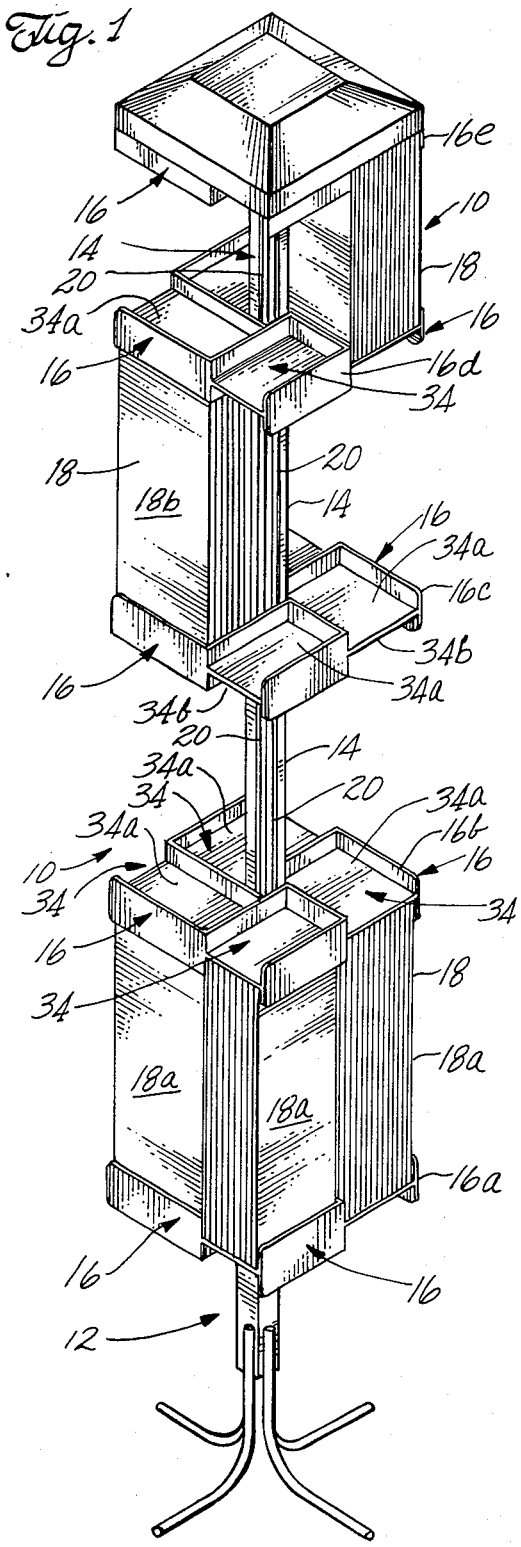
FIG. 1 is a semi-schematic perspective view of one exemplary embodiment of a display rack provided in accordance with practice of principles of this invention.

Referring to FIG. 1, there is shown a semi-schematic perspective view of an exemplary embodiment of a display rack 10 provided in accordance with practice and principles of this invention. The display rack comprises a base 12, an elongated shaft 14 that extends vertically away from the base, and a plurality of shelves or retainers 16 that are spaced apart vertically from each other on the shaft. The shelves are provided for carrying items, such as pamphlets 18, for display. Such pamphlets are shown on portions of only some of the shelves so that the construction of the rack can be clearly seen.

So that all of the items on the display rack can be conveniently accessed, the shaft 14 can be rotated on the base about its longitudinal axis. As is described in greater delatil below, the shelves are fixed in position on the shaft, and therefore, they rotate with the shaft. Thus, the items carried on the shelf can be placed in any desired radial position for viewing.

Figure 2:
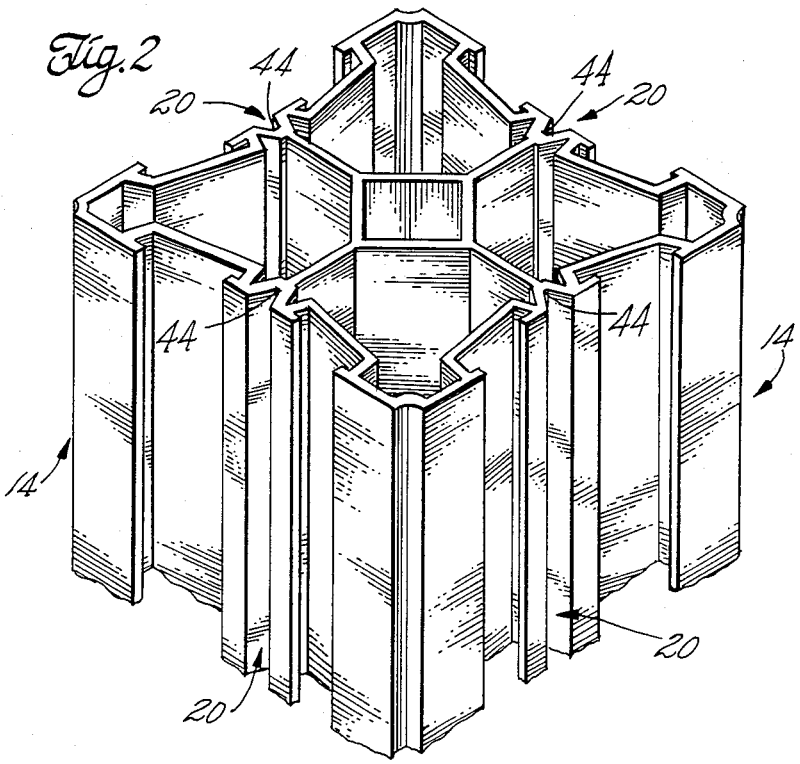
FIG. 2 is a semi-schematic, fragmentary, perspective view of one embodiment of an elongated shaft on which the shelves comprising the display rack of this invention are mounted.

Referring to FIG. 2, in addition to FIG. 1, it can be seen that the shaft 14 of the illustrated embodiment is generally square in horizontal cross section. There are four V-shaped, equal-sized grooves 20 (best seen in FIG. 2) along the length of the shaft in its outer surface. The grooves are equally spaced apart from each other around the shaft perimeter.

It should be understood that although the shaft 14 is square in horizontal cross section, shafts provided in accordance with this invention can have shaped other than square. For example, referring to FIG. 3, a shaft 24 provided in accordance with this invention is cylindrical in horizontal cross section, and, as was the case with the shaft 14, it has four V-shaped grooves 26 in its surface along its length which are equally spaced apart from each other around its perimeter.

As is described below in greater detail, the grooves provide means for mounting the shelves on the shaft. Although shafts, such as the shaft 14, are currently available in the marketplace, there is no teaching or suggestion in the art that such shafts can be used in the construction of a display rack, such as the rack provided in accordance with practice of this invention.

Figure 3:
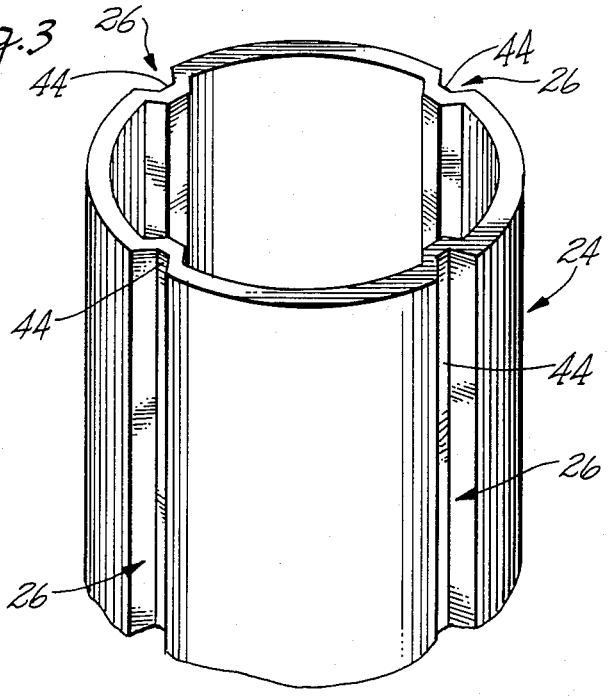
FIG. 3 is a semi-schematic, fragmentary, perspective view of another embodiment of an elongated shaft on which the shelves comprising the display rack of this invention are mounted.
Figure 4:
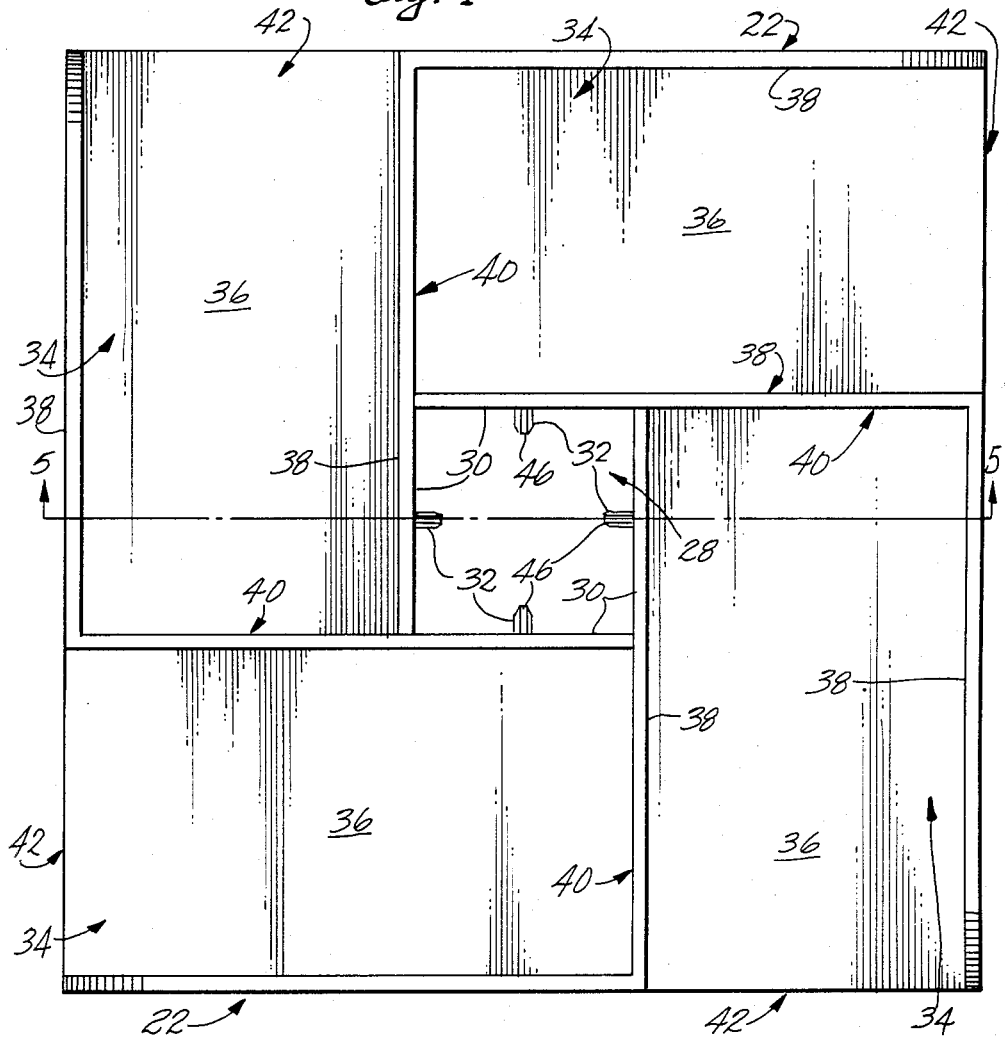
FIG. 4 is a semi-schematic plan view of one embodiment of a shelf comprising the display rack of this invention.
Figure 5:
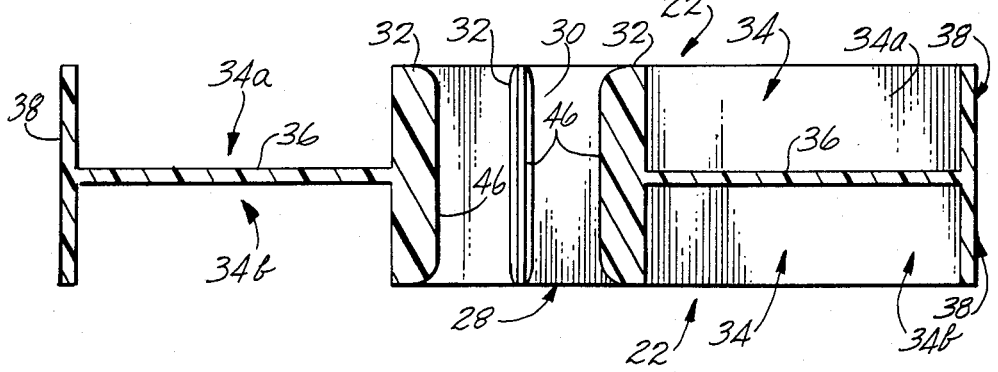
FIG. 5 is a cross sectional view taken along line 5—5 of FIG. 4.

Referring particularly of FIGS. 4 and 5, the construction of the shelves 22 provided in accordance with this invention, and which are shown mounted on the shaft 14 in FIG. 1, can be understood. Each such shelf 22 has a vertical opening 28 through its center along its height. In the illustrated embodiment, the opening is square in horizontal cross section, and thus it has four sides 30. An elongated guide or tongue 32 extends from each side of the opening with each such guide extending along the opening's height or length. As is described in greater detail below, each guide 32 is positioned on the shelf to mate with an associated groove in the shaft when the display rack is assembled. Therefore, since the grooves in the shaft 14 (shown in FIGS. 1 and 2) and in the shaft 24 (shown in FIG. 3) are equally spaced from each other, the guides 32 are equally spaced from each other with each such guide being along the center of one of the sides of the shelf opening.

In the illustrated embodiment, spaced around both the top and bottom of each such shelf 22 are four support modules 34. Each bottom or lower support module **34*b* is identical to the associated top module 34*a***, except that the bottom modules open downwardly while the top modules open upwardly. Furthermore, each such module is similar to the construction of each other module, except for its position on the shelf.

Each module 34 comprises a flat, horiziontally extending partition 36 that is common to the top and bottom modules of each such pair of modules **34*b* and 34*a*. The sides of each module are defined by a pair of vertically extending walls 38 that are along both sides of the partition 36. Each module is closed at its interior end 40 and is open at its exterior end 42**. Adjacent modules are aligned with their open ends 90° from each other.

Although the shelves of the illustrated embodiment each comprise four pairs of top and bottom modules **34*a* and 34*b***, respectively, shelves with more or fewer module pairs are contemplated.

Referring again to FIG. 1, there are five shelves 16 on the rack 10 provided to hold four sets of items, such as the pamphlets 18. A first set of pamphlets **18*a* is held between the shelves 16*a* and 16*b*; a second set of pamphlets (not shown) is held between the shelves 16*b* and 16*c*; a third set of pamphlets 18*b* is held between the shelves 16*c* and 16*d*; and a fourth set of pamphlets 18*c* is held between the shelves 16*d* and 16*e*. The pamphlets are held at their tops by an associated downwardly-facing module 34*b* and at their bottoms by an associated upwardly-facing module 34*a***.

Preferably, both the shelves 16 and the shaft 14, shown in FIGS. 1 and 2 (or the shaft 24 shown in FIG. 3), can be made of plastic. For example, the shafts can be made of extruded plastics, such as high-impact polystyrene, ABS, polyvinylchloride (PVC), or the like. The shelves can be made of injection-molded plastic, for example, polystyrene, acrylics, polycarbonates, or the like.

Preferably, the shelves are clear (i.e., transparent, or at least translucent) so that the items (in this case, pamphlets) can be clearly seen through that portion of the shelf, i.e., the walls 38, which are between the pamphlet and the viewer. When transparent shelves are used, they essentially are not seen, while the items on the rack are in full view. This enhances the attractiveness of the display.

Figure 6:
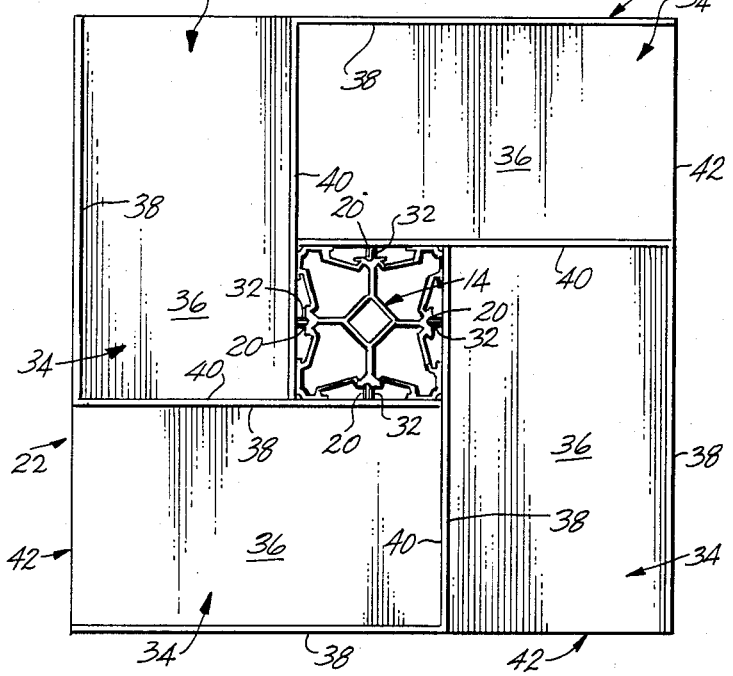
FIG. 6 is a semi-schematic top view in partial cross section of the shelf shown in FIGS. 4 and 5 mounted on the elongated shaft shown in FIG. 2.
Figure 7:
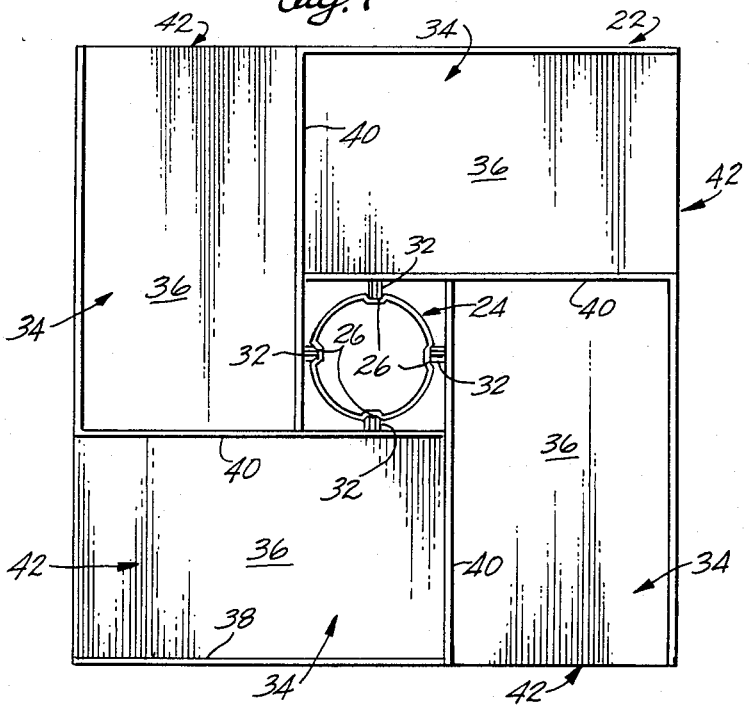
FIG. 7 is a semi-schematic top view in partial cross section of the self shown in FIGS. 4 and 5 mounted in the elongated shaft shown in FIG. 3.

Referring to FIGS. 6 and 7, in addition to FIG. 1, the method used for mounting the shelves on the shaft can be understood. Such mounting is accomplished by the same procedure whether the shaft is square in horizontal cross section, as is shown in FIGS. 1, 2, and 6, or is circular in horizontal cross section, as is shown in FIGS. 3 and 7.

The first step in assembling the rack 10 is to determine the number and spacing of the shelves to be provided. In accordance with this invention, any number of shelves can be used, and they can be spaced apart as desired.

The shelves to be assembled on the shaft are then placed in a fixture in their desired final spacing with their center openings aligned with each other. The shaft is then aligned so that the shaft grooves 20 of the shaft 14 (or the grooves 26 of the shaft 24) are in alignment with associated shelf guides 32. The shaft is then pushed through the opening of the first shelf and thence through the openings of the remaining shelves until the shaft is through the opening of the last shelf on the fixture. The assembled shaft and shelf assembly is then removed from the fixture for further assembly, for example, for assembly on the base. The guides and grooves are of a size so that the guides fit tightly into the grooves. This provides that the shelves remain firmly in place in position on the shaft by a friction fit between the guides and grooves.

When the assembly of the shaft and shelves is accomplished using machinery specially designed by me, a single operator can produce shaft units 60 inches in length with up to seven shelves at an approximate rate of 120 per hour.

A key feature of this invention is the compatible shape of the guides and grooves for providing a tight friction fit. Thus, for example, it is preferred that the V-shaped grooves have flat bottom surfaces 44 (best seen in FIG. 2 and 3) for mating with and frictionally engaging the flat bottom surfaces 46 of the guides 32 (best seen in FIGS. 4 and 5) when the shelf is on the shaft.

In one exemplary embodiment of practice of this invention, it is preferred that the distance between the flat surfaces 46 of each pair of opposing shelf guides is from about 0.010 of an inch to about 0.100 of an inch less than the distance between the flat bottom surfaces 44 of each pair of opposing shaft grooves before the shelf is mounted on the shaft. By providing a shaft and shelf having such groove and guide dimensions, the guides compress the shaft so that the distance between the flat bottom surfaces of each opposing pair of shelf grooves is about equal to the distance between the surfaces of the shelf guides when the shelf is on the shaft. This provides a press or friction fit between the flat surfaces of each shelf guide and the associated shaft groove so that the shelves are fixed securely onto the shaft.

It has been found that when the guides and grooves are provided with the preferred dimensions described above, and when the shelf is made of a slightly softer plastic than the shaft, the flat surfaces of the guides are shaved off slightly when the shaft is being pushed through the shelf opening. This enhances the friction fit between the flat guide surfaces and flat surfaces of the grooves so that the shelf is held firmly in place on the shaft.

If desired, however, after the shelves are mounted on the shaft, a solvent can be introduced into the grooves to contact the guides, thereby cementing the shelves onto the shaft.

Although the display rack of this invention is described above as having five shelves, it can be understood that any number of shelves can easily be provided with any desired spacing. This enhances the versatility of the rack without adding substantially to its cost.

The above description of preferred embodiments of the display rack provided in accordance with this invention is for illustrative purposes. Because of variations which will be apparent to those skilled in the art, the present invention is not intended to be limited to the particular embodiments described above. The scope of the invention is defined in the following claims.

What is claimed is:

1. A display rack comprising:

a base;

an elongated shaft rotatably mounted on the base extending away from the base, the elongated shaft having at least one groove in its outer surface extending along the lenght of the shaft;

at least one shelf mounted on the shaft, such a shelf having an opening therethrough; and at least one elongated guide on the shelf extending into the opening from the side of the opening, such an elongated guide being along the height of the opening and aligned for sliding engagement in the shaft groove when the shelf is being mounted on the shaft so that when the shelf is in position on the shaft, the shaft is throught the shelf opening and the shelf guide is frictionally engaged in the shaft groove.

2. A display rack as claimed in claim 1 wherein the shelf opening is through the center of the shelf.

3. A display rack as claimed in claim 1 wherein:

The elongated shaft has four such enlongated grooves in its outer surface and the distance between each pair of adjacent grooves is about equal; and the shelf includes four such elongated guides wherein each such guide is engaged in an associated shaft groove when the shelf is on the shaft.

4. A display rack as claimed in claim 1 wherein such a shaft groove has a V-shaped cross section with the bottom surface of the V being generally flat, and wherein such an elongated guide has a generally flat surface facing the shelf opening so that when the shelf is mounted on the shaft the generally flat surface of the elongated guide frictionally engages the generally flat surface of the groove.

5. A display rack as claimed in claim 1 wherein:

the elongated shaft has four such elongated grooves in its outer surface and the distance between each pair of adjacent grooves is about equal, each such shaft groove having a V-shaped cross section with the bottom surface of the V being generally flat; and the shelf includes four such elongated guides positioned for engagement in associated shaft grooves, wherein each such elongated guide has a generally flat surface facing the shelf opening so that when the shelf is mounted on the shaft the generally flat surface of such an elongated guide frictionally engages the generally flat surface of its associated groove.

6. A display rack according to claim 5 wherein before the shelf is mounted in the shaft, the distance between the flat surfaces of each pair of opposing shelf guides is from about 0.010 of an inch to about 0.100 of an inch less than the distance between the flat bottom surfaces of each pair of opposing shaft grooves to thereby provide that when the shelf is being mounted on the shaft the guides compress the shaft so that the distance between the flat bottom surfaces of each such pair of opposing shaft grooves is about equal to the distance between the flat surfaces of the shelf guides to thereby provide a friction fit between the flat surface of each such shelf guide and the flat bottom surface of the associated shelf groove.

7. A display rack comprising:

a base;

an elongated shaft rotatably mounted on the base extending away from the base, the elongated shaft having four grooves in its outer surface wherein the grooves are equidistantly spaced apart from each other around the perimeter of the shaft and extend along the length of the shaft, each such groove having a V-shaped cross section with the bottom surface of the V being generally flat;

at least one shelf mounted on the shaft, such a shelf having an opening throught about its center and including four elongated guides spaced apart from each other around the perimeter of the opening, wherein each such elongated guide extends into the opening from the side of the opening, is along the height of the opening, and is aligned for sliding engagement in one of the grooves in the outer surface of the shaft when the shelf is being mounted on the shaft, each such guide having a generally flat surface facing the shelf opening so that when the shelf is mounted on the shaft, the shaft is through the shelf opening and the generally flat surface of each such shelf guide frictionally engages the generally flat bottom surface of an associated shaft groove.

8. A display rack according to claim 7 wherein before the shelf is mounted in the shaft, the distance between the flat surfaces of each pair of opposing shelf guides is from about 0.010 of an inch to about 0.100 of an inch less than the distance between the flat bottom surfaces of each pair of opposing shaft grooves so that when the shelf is being mounted on the shaft the guides compress the shaft so that the distance between the flat bottom surfaces of each such pair of opposing shaft grooves is about equal to the distance between the flat surfaces of the shelf guides to thereby provide a friction fit between the flat surface of each such shelf guide and the flat bottom surface of the associated shelf groove.

* * * * *